US006647586B2

(12) United States Patent
Rogers et al.

(10) Patent No.: US 6,647,586 B2
(45) Date of Patent: Nov. 18, 2003

(54) PORTABLE VACUUM CLEANING APPARATUS

(76) Inventors: Alma L. Rogers, 204 Stone Cutters Walk, Stockbridge, GA (US) 30281; Dietrich Hoecht, 455 Hoke O'Kelly Mill Rd., Loganville, GA (US) 30052

( * ) Notice: Subject to any disclaimer, the term of this patent is extended or adjusted under 35 U.S.C. 154(b) by 0 days.

(21) Appl. No.: 10/012,747

(22) Filed: Dec. 7, 2001

(65) Prior Publication Data

US 2002/0104184 A1 Aug. 8, 2002

Related U.S. Application Data

(60) Provisional application No. 60/266,548, filed on Feb. 5, 2001.

(51) Int. Cl.[7] ..... A47L 9/22

(52) U.S. Cl. ..... 15/327.5; 15/323; 15/330; 15/344

(58) Field of Search ..... 15/327.5, 330, 15/344, 323

(56) References Cited

U.S. PATENT DOCUMENTS

| | | | | |
|---|---|---|---|---|
| 1,255,662 A | | 2/1918 | Sullivan | |
| 1,365,851 A | | 1/1921 | Reynolds | |
| 3,110,922 A | | 11/1963 | Senne | |
| D204,366 S | | 4/1966 | Nelson | |
| 3,308,608 A | | 3/1967 | Brimberg | |
| 3,464,081 A | | 9/1969 | Wisner | |
| D219,835 S | | 2/1971 | Otto et al. | |
| 4,185,355 A | * | 1/1980 | Williams | 15/344 |
| 4,570,286 A | | 2/1986 | Ross | |
| 4,653,142 A | | 3/1987 | Upton | |
| 4,748,712 A | | 6/1988 | DiGiovanni | |
| 4,944,065 A | | 7/1990 | Svanberg et al. | |
| D315,234 S | | 3/1991 | Frisell | |
| D326,747 S | | 6/1992 | Stickle | |
| 5,267,371 A | * | 12/1993 | Soler et al. | 15/327.5 |
| 5,588,177 A | | 12/1996 | Eriksen | |
| D398,426 S | | 9/1998 | Bisson | |
| 6,006,399 A | | 12/1999 | Massaro | |
| 6,115,879 A | * | 9/2000 | Mitchell | 15/327.5 |
| 6,295,692 B1 | * | 10/2001 | Shideler | 15/327.5 |

* cited by examiner

*Primary Examiner*—Theresa T. Snider
(74) *Attorney, Agent, or Firm*—Myers & Kaplan Intellectual Property Law Office; Barry E. Kaplan, Esq.; Joel D. Myers, Esq.

(57) ABSTRACT

A portable vacuum cleaning apparatus intended to be carried either on a single shoulder or worn backpack style, wherein the vacuum cleaner has an extensible tube and nozzle arrangement that may be held substantially fully enclosed in the vacuum cleaner case, wherein the hose or wand may be collapsed when not in use to prevent entanglement, or may be incrementally extended and secured in a desired position for use. Additional advantages of the present invention include a suspension arrangement for flexibly suspending the internal components of the vacuum and for providing a moment to counteract the force and movement of the wand.

20 Claims, 7 Drawing Sheets

PORTABLE VACUUM CLEANING APPARATUS

RELATED APPLICATIONS

The inventors hereof claim priority pursuant to U.S. provisional patent application Ser. No. 60/266,548 filed on Feb. 5, 2001.

TECHNICAL FIELD

The present invention relates generally to vacuum cleaning devices and, more specifically, to a portable, cordless vacuum cleaner having an extensible tube and nozzle arrangement that may be held fully enclosed in the cleaner case. The present invention is particularly useful in, although not strictly limited to, elevated cleaning applications advantageously utilizing counterbalanced weight and entanglement-free climbing, such as for vacuuming fans, chandeliers, steps, lights, shelves, fireplace vents, and the like.

BACKGROUND OF THE INVENTION

The cleaning of remote, high elevation items such as fans, chandeliers, steps, lights, shelves, fireplace vents, and the like, is difficult and often dangerous. The carrying of supplies or appliances, for example, prevents full use of the hands for stabilization, and added weight often impairs a person's natural balance when climbing steps or a ladder. Moreover, dangling vacuum cords and hoses can result in entanglement and, thus, a hazard to the user.

Several attempts have been made to design a suitable and effective device for remote cleaning and vacuuming. Examples of such devices may be found by reference to U.S. Pat. No. 1,365,851 to Reynolds, U.S. Pat. No. 3,100,922 to Senne, U.S. Pat. No. 4,570,286 to Ross, and U.S. Pat. No. 4,748,712 to DiGiovanni. In view of the present invention, however, these patents are disadvantageous.

For instance, the configuration of U.S. Pat. No. 4,570,286 consists of a shoulder carried vacuum cleaning device. A disadvantage of this design is the self-described "elbow-shaped" plastic housing of the vacuum motor unit. When carried on the shoulder, the housing extends frontward and substantially perpendicular to the user's body, wherein the weight of the unit remains localized; thereby, pulling the user's body forward. In addition, the frontwardly extended housing potentially endangers a user by hindering navigation of ladders and the like. Furthermore, the device requires the attachment of a long hose or nozzle; thus, resulting in an additional hindrance to safe climbing.

Another configuration, described in the above-referenced U.S. Pat. No. 4,748,712, incorporates a battery-powered, shoulder carried vacuum cleaner. This cleaner, while it may reduce some of the previously described weight distribution problems, does not alleviate the problems caused by the use of dangling non-collapsible hose and extensions. Even the alternative telescoping extension device dangles dangerously from the end of a flexible hose, potentially entangling within the rungs of a ladder.

U.S. Pat. No. 1,365,851 describes a telescoping handle, much like the alternate embodiment of the previously described vacuum. Because the collapsed handle or tube extends from a vacuum motor unit, the disadvantages of this design, as discussed above, remain.

U.S. Pat. No. 3,100,922 teaches a collapsing hose having specific application for vacuum cleaners. This hose, however, is disadvantageously complex. Although it does fully collapse when not in use, it requires inflation prior to use. Thus, once on top of a ladder, it is necessary to perform manipulations to inflate and extend the hose and to mount vacuum attachments to the inflated hose, all while trying to maintain balance. Furthermore, the increased complexity of the hose design may create increased opportunity for failure of the system.

It is, therefore, readily apparent that there is a need for a light-weight strategically-balanced portable vacuum cleaning device having a simple, extensible tube and nozzle arrangement that may be held fully enclosed in the cleaner case; thereby, providing for increased climbing safety and solving the above-discussed disadvantages.

BRIEF SUMMARY OF THE INVENTION

Briefly described, in a preferred embodiment, the present invention overcomes the above-mentioned disadvantages, and meets the recognized need for such a device, by providing a portable, cordless vacuum cleaner having an extensible telescoping tube and nozzle arrangement that may be held fully enclosed in the cleaner case.

According to its major aspects and broadly stated, the present invention is a portable vacuum cleaner intended to be carried either on a single shoulder or worn backpack style, wherein the hose or wand may be collapsed when not in use so as to remain out of the way and thus prevent entanglement and interference during a transport.

More specifically, the present invention is a portable vacuum cleaning system having a motor, fan, dust bag and battery pack housed within a flexible case, and wherein the vacuum hose or wand is connected to and in communication with dust bag. The hose or wand may remain fully collapsed within said case when not in use, or may be incrementally extended for use, as desired.

The portable vacuum cleaner of the present invention further comprises a novel counterbalancing leaf spring to compensate for the weight of the extended wand. Additionally, the present invention provides for one-handed adjustment, locking, and unlocking locking of the various wand sections through a mechanism whereby each section is freely rotated and locked into a user-selected position. Such functionality allows for vacuum attachments to be oriented in any direction without retraction of the wand.

Thus, an object, feature, and advantage of the present invention is to provide a portable vacuum-cleaning device having centralized weight distribution for easy carrying.

Another object, feature, and advantage of the present invention is the ability of such a device to be used on a ladder with minimum hindrance.

Yet another object, feature, and advantage of the present invention is the ability of such a device to be operated with one hand.

Still another object, feature, and advantage of the present invention is the ability of such a device to provide access to internal components via a removable cover or zipper carried in the housing.

Yet still another object, feature, and advantage of the present invention is to provide a portable vacuum cleaner, wherein all major components are carried in hanging suspension.

A further object, feature, and advantage of the present invention is to provide a portable vacuum cleaner having a counterbalancing leaf spring to compensate for the weight of the extended wand.

A still further object, feature, and advantage of the present invention is the ability of such a device to provide for one-handed extension, collapsing, locking and unlocking of the telescoping tube sections.

Another and still further object, feature, and advantage of the present invention is the ability of such a device to provide a mechanism that allows independent locking of all tubing sections at any longitudinal position along the tubing length.

Yet another and still further object, feature, and advantage of the present invention is the ability of such a device to provide freely selectable rotary position locking of all tube sections; thus, allowing a vacuum attachment to be oriented in any direction via simple wrist rotation, without having to collapse and reset the wand.

Yet still another and further object, feature, and advantage of the present invention is the ability to provide a portable vacuum cleaner, whereby the weight of the extended wand is partially counterbalanced by a gravity moment exerted by the center of gravity of the suspended weight assembly.

These and other objects, features, and advantages of the invention will become more apparent to one skilled in the art from the following Detailed Description of the Preferred and Alternate Embodiments and claims when read in view of the accompanying Drawings.

BRIEF DESCRIPTION OF THE DRAWINGS

The present invention will be better understood by reading the Detailed Description of the Preferred and Alternate Embodiments with reference to the accompanying drawing Figures, in which like reference numerals denote similar structure and refer to like elements throughout, and in which.

It is to be noted that the Figures presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE PREFERRED AND ALTERNATE EMBODIMENTS

In describing the preferred and alternate embodiments of the present invention, as illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
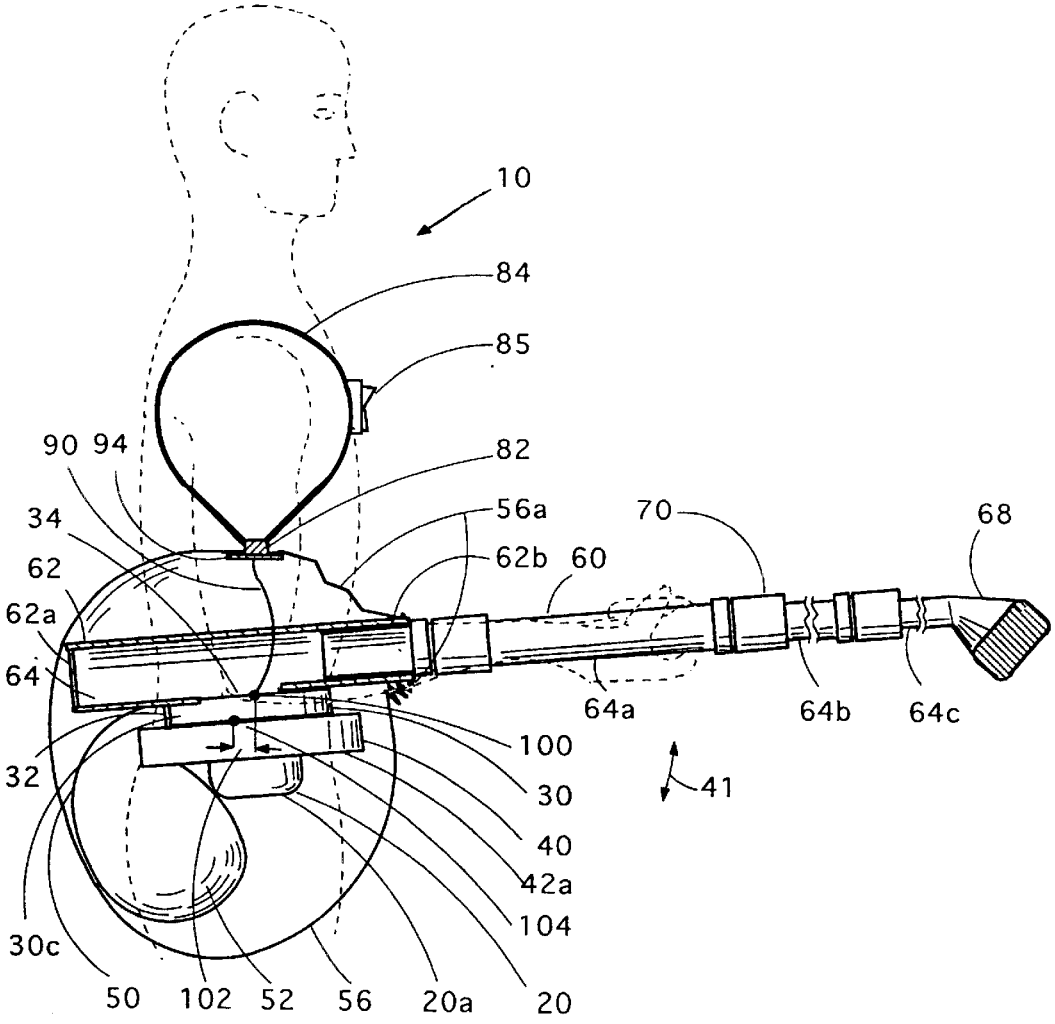
FIG. 1 is a sectional side view of a shoulder carried vacuum cleaning device according to a preferred embodiment of the present invention showing a telescoping wand in an extended and lowered position.
Figure 2:
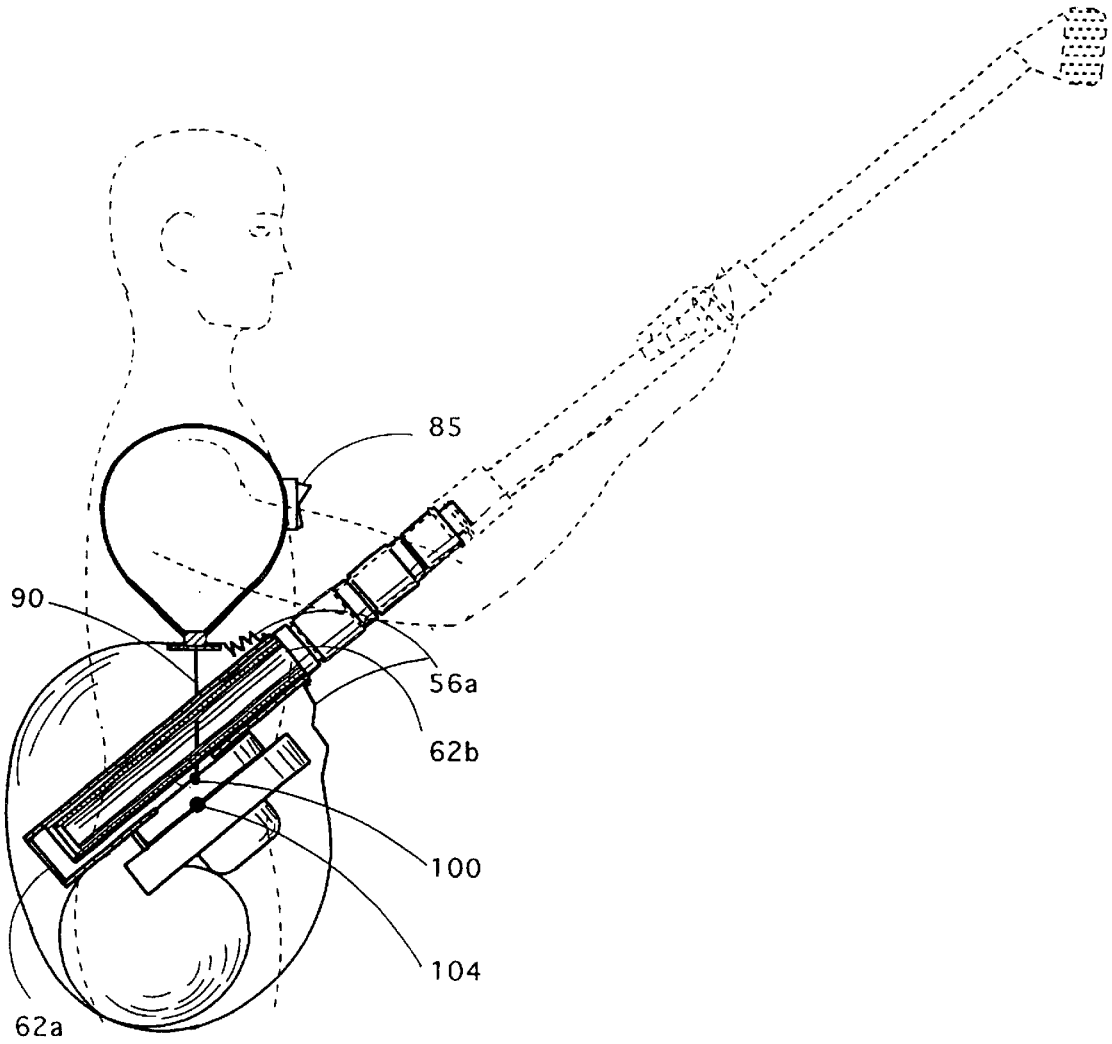
FIG. 2 is a sectional side view of the vacuum-cleaning device of FIG. 1 showing the telescoping wand in an extended and raised resting position.

Referring now to FIGS. 1 and 2, the present invention is a vacuum cleaning device 10 comprising motor 20, fan 30, power source 40, debris receptacle 50 and telescoping wand 60. Preferably, the power source 40 comprises rechargeable batteries 42*a* and 42*b*, wherein batteries 42*a* and 42*b* are electrically connected to motor 20, and wherein batteries 42*a* and 42*b* are positioned on opposing sides 20*a* and 20*b*, respectively, of motor 20. Power switch 85, carried by shoulder strap 84, is electrically connected with and controls the electric current to motor 20 and fan 30. Power switch 85 is preferably positioned approximately at the chest level of the user to facilitate easy operation by either hand.

Figure 3:
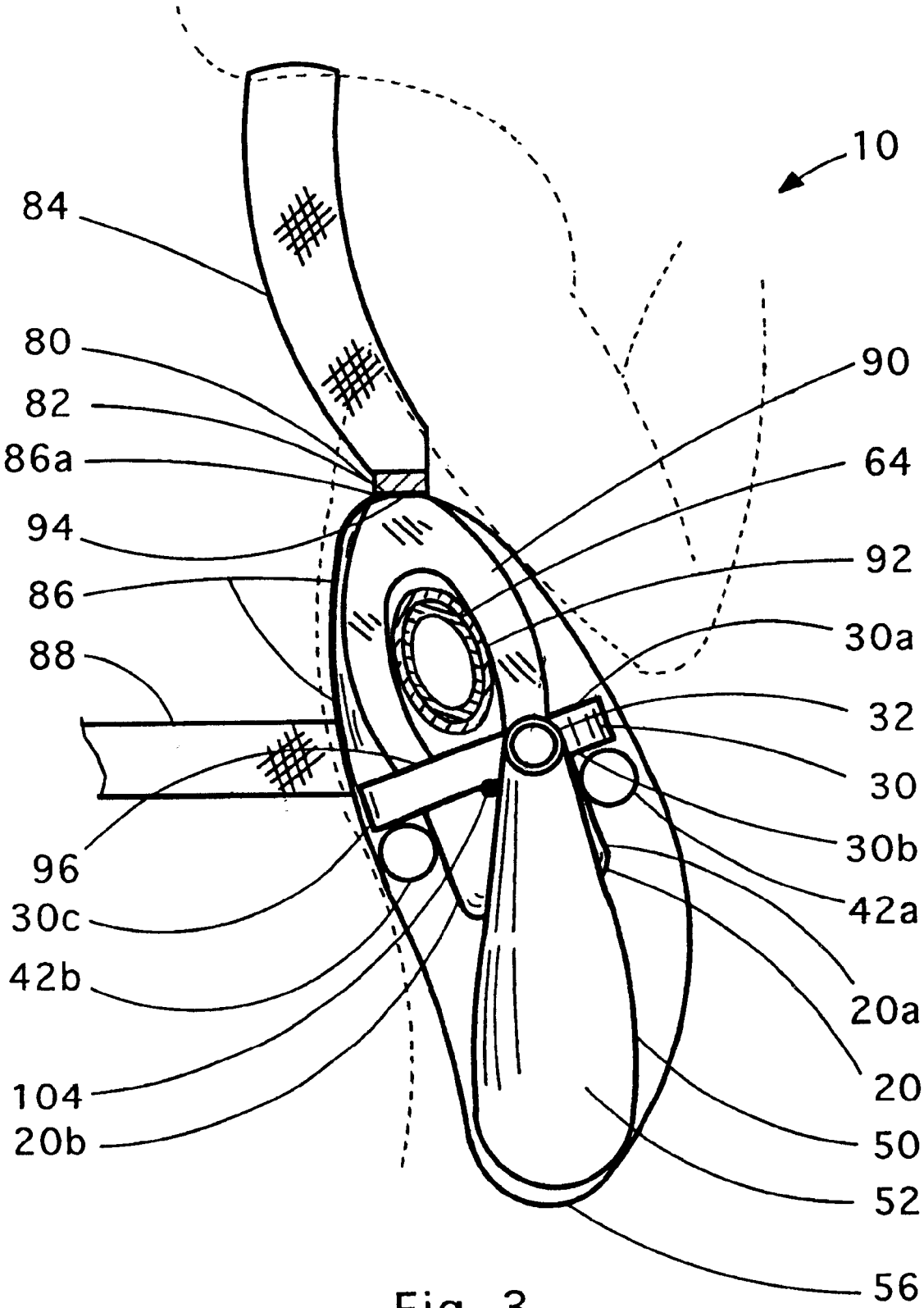
FIG. 3 is a sectional rear view of the vacuum cleaning device of FIG. 1.

Best seen with reference to FIG. 3, fan 30 comprises first side 30*a*, second side 30*b* and peripheral wall 30*c*. Preferably, motor 20 is coupled to second side 30*b* of fan 30, approximately centered relative thereto, for driving fan 30. Fan 30 has exhaust port 32 defined within peripheral wall 30*c*, and intake port 34 within first side 30*a*. Extending from and mounted to exhaust port 32 of fan 30 is the debris receptacle 50, preferably comprising a dust bag 52. When current is allowed to travel from power source 40 to motor 20 via power switch 85, fan 30 is rotated; thereby, producing a vacuum within the tube and a positive pressure for directing debris into receptacle 50. Access to internal components, including motor 20, fan 30, power source 40, and debris receptacle 50 is preferably obtained via removable cover 56.

Telescoping wand 60 is housed within wand container 62 wherein the wand container 62 has a first end 62*a* and a second end 62*b*. First end 62*a* of wand container 62 is attached proximal to intake port 34 of fan 30. Second end 62*b* extends through a flexible aperture 56*a* in cover 56, wherein flexible aperture 56*a* maintains a seal encircling wand container 62. Wand container 62 is dimensioned to nearly fully receive and house telescoping wand 60 in a collapsed conformation. Wand container 62 is preferably of substantially rigid construction to provide support for telescoping wand 60 when in an extended position.

Figure 4:
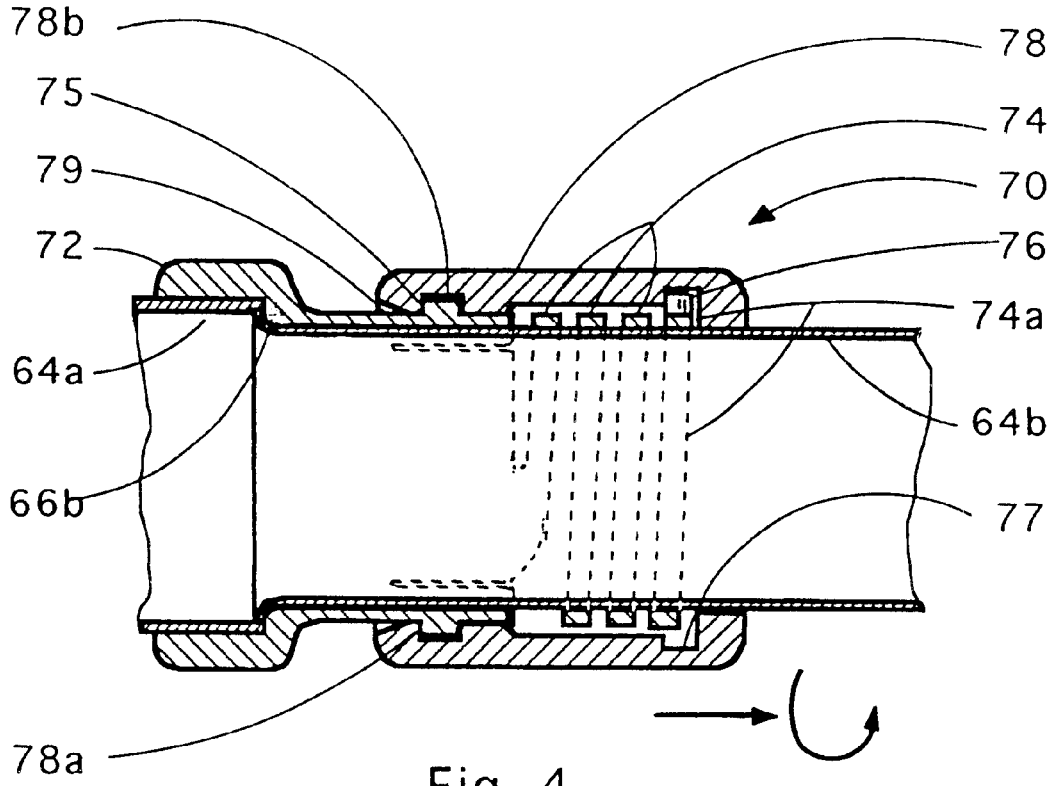
FIG. 4 is a sectional side view of the telescoping lock mechanism of the vacuum-cleaning device of FIG. 1 showing the locked position.
Figure 5:
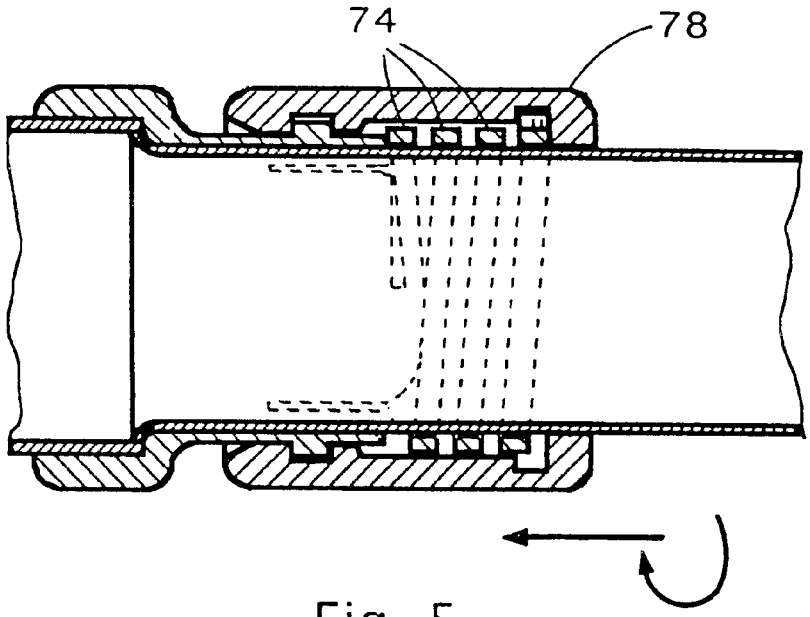
FIG. 5 is a sectional side view of the telescoping lock mechanism of the vacuum-cleaning device of FIG. 1 showing the unlocked position.

Tubing assembly 64 preferably comprises three telescoping members 64*a*, 64*b* and 64*c*, wherein member 64*c* is telescoped within member 64*b*, member 64*b* is telescoped within 64*a*, and 64*a* is telescoped within wand container 62. Preferably, telescoping members 64*a*, 64*b*, 64*c* are cylindrically shaped and are each lockable at any longitudinal position, independent of the extension of the other members. As best seen in FIG. 4 each telescoping member 64*a*, 64*b*, 64*c* has a stop flanges 66*a*, 66*b*, 66*c*, respectively, to prevent inadvertent dislodging or separation of the extended wand 60. Preferably, each telescoping member 64*a*, 64*b*, 64*c* is freely rotatable and selectably lockable, wherein the directional orientation of vacuum attachment 68 can be adjusted by simple hand rotation of wand 60 without collapsing and resetting wand 60.

Figure 6:
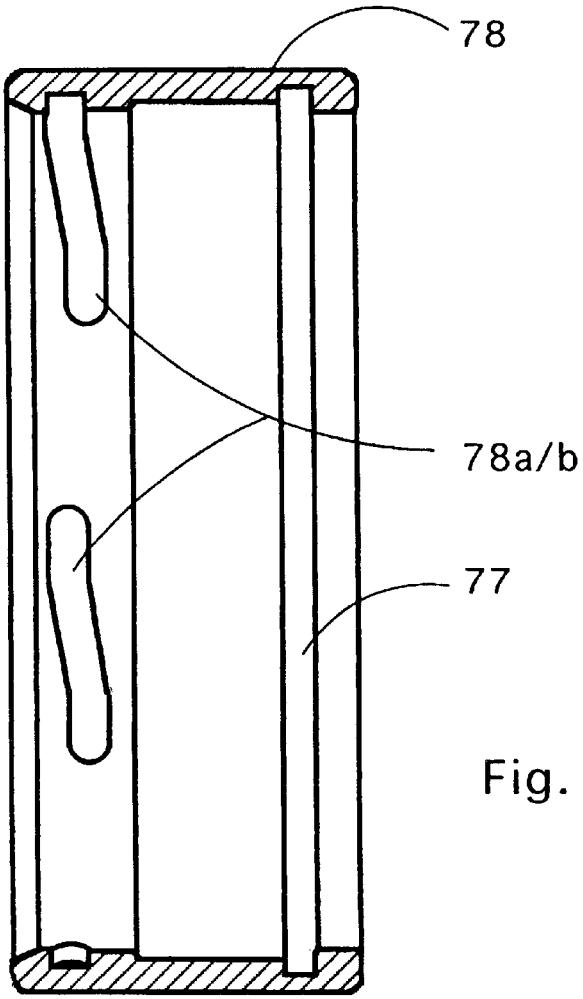
FIG. 6 is a sectional view of the locking sleeve of the vacuum-cleaning device of FIG. 1, unwrapped to demonstrate the guidance slots thereof.
Figure 7:
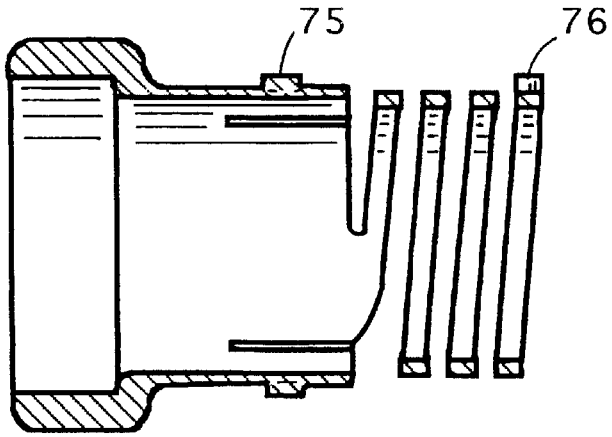
FIG. 7 is a sectional view of the spring fitting of the vacuum-cleaning device of FIG. 1, showing a reduced diameter spring.
Figure 9:
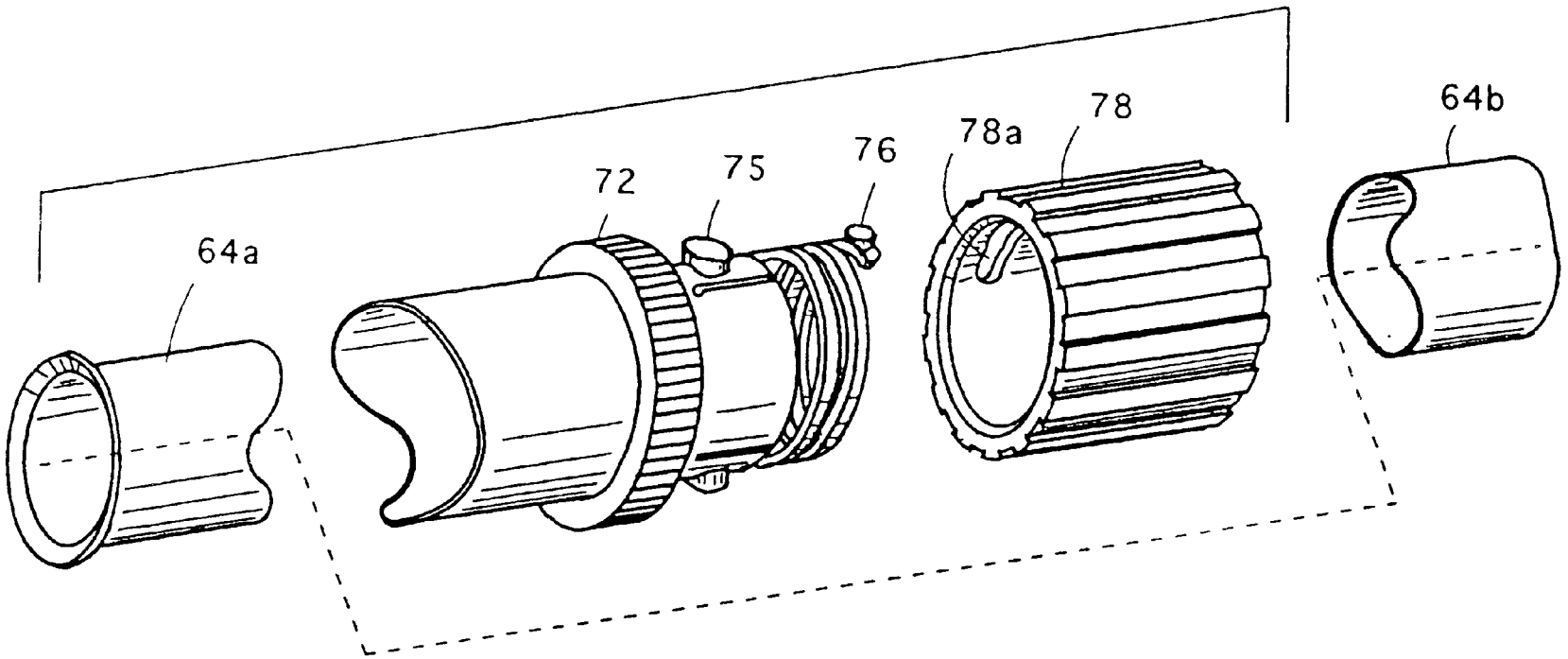

With reference to FIG. 4, and with additional reference to FIGS. 6, 7, and 9, interlocking mechanism 70 is preferably positioned at the distal ends of wand container 62, telescoping member 64*a*, and telescoping member 64*b*, and is preferably designed and manufactured to allow one-handed extending, collapsing, locking and unlocking of telescoping members 64*a*, 64*b* and 64*c*. Interlocking mechanisms 70 adjustably secure wand container 62, telescoping member 64*a* and/or telescoping member 64*b* with an inner telescoped portion of telescoping members 64*a*, 64*b*, and/or 64*c*, respectively. Fitting 72 surrounds the outer surface of the respective telescoping members 64*a*, 64*b* and/or 64*c* and is attached thereto preferably via adhesive or press fit. Fitting 72 comprises coil member 74, coil button 76, guidance slots 78*a*, 78*b*, and guidance buttons 75 confined within a locking sleeve 78.

Although the use of three interlocking mechanisms 70 is preferred, only one interlocking mechanism 70 is shown in FIGS. 4, 6, 7, and 9, and will be described herein. An angled cutout portion 79 is formed at one end of locking sleeve 78 and guidance slot 78*a* is formed proximal thereto. Button 75 is dimensioned to be received within guidance slot 78*a*, wherein locking sleeve 78 is slid such that angled cutout portion 79 is slid over button 75, and wherein button 75 rests within guidance slot 78*a*. The end 74*a* of coil member 74 is connected at coil button 76. Groove 77 mates with button 76. Coil button 76 is formed as an integral part of, or otherwise affixed to, locking sleeve 78 such that when locking sleeve 78 is rotated, end 74*a* of coil member 74 is pushed or pulled to vary the diameter of coil member 74. More specifically, as locking sleeve 78 is rotated and end 74*a* is pulled, the diameter of coil member 74 is reduced; thereby, producing a frictional contact between coil member 74 and telescoping members 64*a* thereby locking telescoping members 64*a* and 64*b* together. As locking sleeve 78 is rotated in the opposite direction and end 74*a* is pushed, the diameter of coil member 74 is increased. Such action releases the frictional contact between coil member 74 and telescoping member 64*a*.

A hanging suspension 80 design, wherein all major components are held in a hanging formation, is provided to allow controlled reaction restraint during twisting movement of the locking sleeve 78 and to further allow free range of motion for wand 60. Hanging suspension 80 extends from a suspension block 82 secured to the base of shoulder strap 84. A preferably semi-rigid enclosure 86 extends from attachment point 86*a* of shoulder strap 84 and suspension block 82. Waist strap 88 is also provided for the user's convenience and comfort, and for stability of the device. Enclosure 86 serves to house all major components.

Extending from attachment point 86*a* and carrying the majority of components in a suspended fashion is leaf spring 90. Leaf spring 90 is resistantly flexible along both the horizontal and vertical axis such that vertical and horizontal movement of wand 60 is controllably resisted as more fully described below. Leaf spring 90 is generally horseshoe shaped having a proximal end 94 and a distal end 96, wherein proximal end 94 is attached to suspension block 82 and distal end 96 is rigidly affixed to the interface of upper side 30*a* of fan 30. Because a majority of the components are carried by leaf spring 90, any movement of wand 60 produces a counterforce by leaf spring 90. More specifically, as wand 60 is raised or lowered, leaf spring 90 bends about a horizontal axis, and as wand 60 is pivoted left or right, leaf spring 90 twists about a vertical axis; thereby, providing controlled resistance. The spatial movement of wand 60 is preferably limited relative to the user, wherein the preferable range of vertical motion is from substantially level to approximately forty degrees upward and downward, and wherein the preferable range of horizontal motion is from substantially level to approximately twenty degrees left or right. It should be noted, however, that other ranges are contemplated within the scope of the invention, such as vertical motion from substantially level to approximately ninety degrees upward and downward, and horizontal motion from substantially level to approximately ninety degrees left or right.

Preferably, leaf spring 90 defines a substantially oval opening 92 wherein wand container 62 extends therethrough and pivots freely therein. This creates a counterbalancing moment 41 with the suspension 80 to compensate for the weight of the wand 60 when fully extended. As shown in FIG. 2, wand 60 is mounted such that when leaf spring 90 is in the resting position, wand 60 is held at approximately a forty-five degree angle above the horizon to facilitate use of the device in upper areas. As shown in FIG. 1, when wand 60 is lowered, leaf spring 90 flexes thereby slightly urging wand 60 in the upward direction. Additionally, the force produced by leaf spring 90 serves as an uprighting moment to counterbalance the weight of the wand 60.

In operation, between suspension block 82 and waist strap 88, enclosure 86 is preferably either semi-rigid or rigid, in order to transfer the leaf spring moment to straps 84, 88. The moment is created when wand 60 is rotated about its own axis (i.e., the tube center), when locking and unlocking locking sleeves. This torsional moment is carried through leaf spring 90 into block 82, and from there to waist strap 88 via the semi-rigid portion of enclosure 86, reacting in bending, and resisted by straps 84, 88.

Figures 8, 8A, 8B, 8C, 8D:
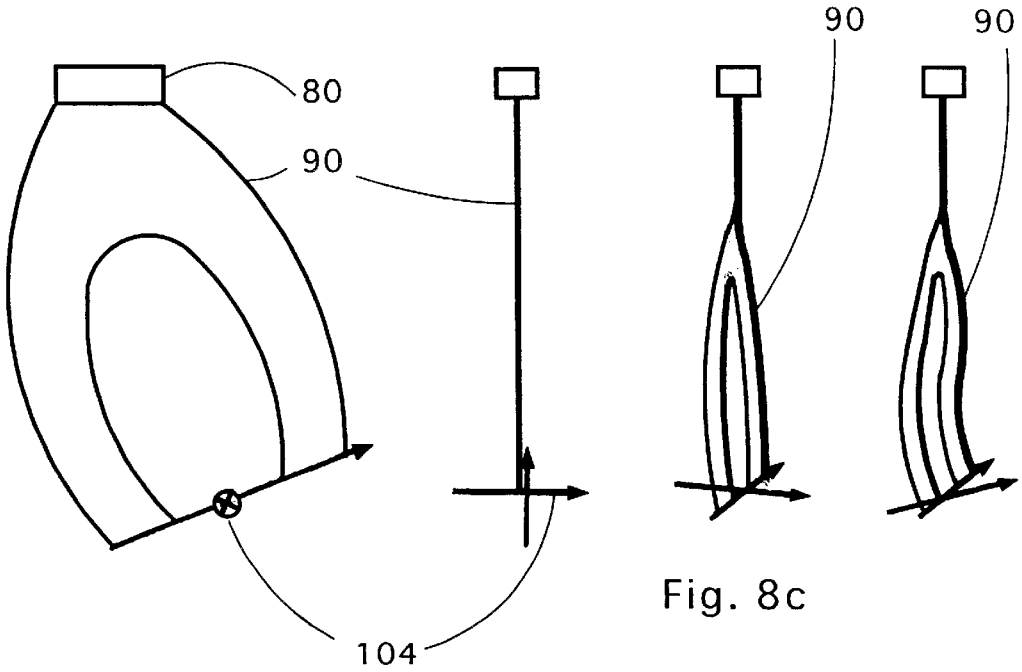
FIG. 8*a* is a rear view of the suspension of the vacuum-cleaning device of FIG. 1.
FIGS. 8*b* through 8*d* are side views of the leaf spring of the suspension of the vacuum-cleaning device of FIG. 1, in positions of neutral, wand pointed left, and wand pointed left and upwardly, respectively; and, FIG. 9 is a perspective exploded view of the wand locking mechanism of the vacuum-cleaning device of FIG. 1.

It is not only leaf spring 90 which provides counterbalancing of wand 60 in its extended position, but also the gravity moment of the assembly. According to the instant design, and with reference generally to FIGS. 8 through 8*d*, the suspended combined center of gravity is positioned below the lower attachment point 100 of leaf spring 90. The center of gravity 104 is in-line vertically with leaf spring 90 when wand 60 is extended and upwardly pointing. Hence, there is no effective moment arm. When wand 60 is pointed horizontally, however, the center of gravity 104 has rotated backward to offset position 102, and exerts a reaction moment to the increased moment arm of the forwardly disposed wand assembly.

It should be noted that a variety of alternate embodiments are contemplated within the scope of the present invention. For example, in one alternate embodiment, the cover 56 could be non-removable and access to internal components, such as the motor 20, fan 30, power source 40, and debris receptacle 50 could be via a zipper.

Similarly, in another alternate embodiment, the cover 56 could be substantially heart-shaped to provide arm or shoulder clearance for the comfort of the user.

In still another alternate embodiment, the debris receptacle 50 could be a disposable bag.

In yet another alternate embodiment, the vacuum system could include a fine particulate filter, such as, for exemplary purposes only, a HEPA filter.

In yet still another alternate embodiment, the power source 40 could be an electrical cord, the cord being optionally retractable into the cover 56.

In a further alternate embodiment, the power source 40 could be a single battery, or a plurality of batteries.

In another and further alternate embodiment, the inner components could be positioned in a different spatial arrangement, wherein the hanging suspension remains substantially unaffected.

In yet another and further alternate embodiment, the wand 60 could have a plurality of sections for a variety of overall lengths.

In still another and further alternate embodiment, there could be a plurality of shoulder straps to allow for backpack-style wear.

In yet still another and further alternate embodiment, the power switch 85 could be carried by the cover 56.

Having now fully described the major elements and parts comprising the invention, including the functional interrelationship thereof, the manner of use of the invention shall now be described. In use, shoulder strap 84 is placed over the user's shoulder, with the vacuum unit suspended therefrom and flexible aperture 56*a* directed to the front of the user. For climbing or moving from one area to another, wand 60 is substantially fully collapsed and housed within wand container 62, substantially within cover 56, allowing both of the user's hands to remain free. For vacuuming, any or all of telescoping pieces 64*a*, 64*b*, 64*c* of wand 60 are extended to the desired length and locked into place. According to the invention, this action may be accomplished utilizing only one of the user's hands; thereby, allowing the other hand to remain free for stabilization. Power switch 85 is activated and the motor and fan create a vacuum suction within wand 60, wherein debris is drawn into the unit and deposited within debris receptacle 50. For the user's convenience, and, again, according to the present invention, the wand 60 may be moved or swept in vertical, horizontal, or arcuate fashion to more readily enable the user to reach and access areas to be cleaned, all without upsetting the balance of the user or causing the vacuum housing to sway unstably about the user's torso region.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A portable vacuum cleaning apparatus, comprising:

(a.) a power source;

(b.) a motor electrically interconnected with said power source;

(c.) a fan having an intake port and an exhaust port, said fan electrically interconnected with and driven by said motor;

(d.) a debris receptacle in fluid communication with said exhaust port of said fan;

(e.) an extensible wand;

(f.) a housing, wherein said power source, said motor, said fan, said debris receptacle, and said extensible wand, when said extensible wand is in a retracted position, are carried substantially within said housing; and, (g.) means for flexibly suspending said motor, said fan, said power source, said debris receptacle, and said wand within said housing.

2. The portable vacuum cleaning apparatus of claim 1, further comprising means for carrying said housing.

3. The portable vacuum cleaning apparatus of claim 2, wherein said carrying means comprises a strap.

4. The portable vacuum cleaning apparatus of claim 1, wherein said extensible wand further comprises a plurality of telescoping sections.

5. The portable vacuum cleaning apparatus of claim 4, wherein each of said plurality of telescoping sections may be rotated and selectively locked in any of a plurality of extended and rotated positions by interlocking means.

6. The portable vacuum cleaning apparatus of claim 5, wherein said interlocking means comprises a fitting, said fitting comprising a coil member, a coil button, a guidance slot, and a guidance button confined within a locking sleeve.

7. The portable vacuum cleaning apparatus of claim 1, wherein said extensible wand is adapted to be extended from a wand container.

8. The portable vacuum cleaning apparatus of claim 1, wherein said flexible suspension means further comprises a leaf spring.

9. The portable vacuum cleaning apparatus of claim 8, wherein said leaf spring further comprises an opening through which a wand container may extend.

10. The portable vacuum cleaning apparatus of claim 8, wherein said leaf spring provides a moment to counterbalance the weight of said wand when said wand is extended beyond said housing.

11. The portable vacuum cleaning apparatus of claim 8, wherein a center of gravity is established below and in vertical alignment with said leaf spring, when said wand is in an extended and upwardly oriented position, and wherein the center of gravity rotates rearwardly when said wand is brought into an extended and horizontally oriented position.

12. A portable vacuum cleaning apparatus, comprising:

(a.) a power source;

(b.) a motor electrically interconnected with said power source;

(c.) a fan having an intake port and an exhaust port, said fan electrically interconnected with and driven by said motor;

(d.) a debris receptacle in fluid communication with said exhaust port of said fan;

(e.) a telescoping wand;

(f.) a housing, wherein said power source, said motor, said fan, said debris receptacle, and said telescoping wand, when said telescoping wand is in a retracted position, are carried substantially within said housing; and, (g.) a leaf spring for flexibly suspending said motor, said fan, said power source, said debris receptacle, and said wand within said housing, said leaf spring adapted to provide at least a partial counterbalancing moment against a moment exerted by said wand when said wand is at least partially extended.

13. The portable vacuum cleaning apparatus of claim 12, further comprising a strap for carrying said housing.

14. The portable vacuum cleaning apparatus of claim 12, wherein said telescoping wand comprises a plurality of telescoping sections, and wherein each of said plurality of telescoping sections may be rotated and selectively locked in any of a plurality of extended and rotated positions by interlocking means.

15. The portable vacuum cleaning apparatus of claim 14, wherein said interlocking means comprises a fitting, said fitting comprising a coil member, a coil button, a guidance slot, and a guidance button confined within a locking sleeve.

16. The portable vacuum cleaning apparatus of claim 12, wherein said extensible wand is adapted to be extended from a wand container.

17. The portable vacuum cleaning apparatus of claim 12, wherein said leaf spring further comprises an opening through which a wand container may extend.

18. The portable vacuum cleaning apparatus of claim 12, wherein a center of gravity is established below and in vertical alignment with said leaf spring, when said wand is in an extended and upwardly oriented position, and wherein the center of gravity rotates rearwardly when said wand is brought into an extended and horizontally oriented position.

19. A portable vacuum cleaning apparatus, comprising:

(a.) a power source;

(b.) a motor electrically interconnected with said power source;

(c.) a fan having an intake port and an exhaust port, said fan electrically interconnected with and driven by said motor;

(d.) a debris receptacle in fluid communication with said exhaust port of said fan;

(e.) a telescoping wand, said telescoping wand comprising a plurality of telescoping sections, said plurality of sections being independently rotatable and selectively locked in any of a plurality of extended and rotated positions by a fitting, said fitting comprising a coil member, a coil button, a guidance slot, and a guidance button confined within a locking sleeve;

(f.) a housing, wherein said power source, said motor, said fan, said debris receptacle, and said telescoping wand, when said telescoping wand is in a retracted position, are carried substantially within said housing;

(g.) a strap for carrying said housing; and, (h.) a leaf spring for flexibly suspending said motor, said fan, said power source, said debris receptacle, and said wand within said housing, said leaf spring adapted to provide at least a partial counterbalancing moment against a moment exerted by said wand when said wand is at least partially extended.

20. The portable vacuum cleaning apparatus of claim 19, wherein a center of gravity is established below and in vertical alignment with said leaf spring, when said wand is in an extended and upwardly oriented position, and wherein the center of gravity rotates rearwardly when said wand is brought into an extended and horizontally oriented position.

* * * * *